US005528917A

United States Patent [19]

Bajraszewski et al.

[11] Patent Number: 5,528,917

[45] Date of Patent: Jun. 25, 1996

[54] FORCE CONTROLLED ROLLING OF GEARS

[75] Inventors: Alexander Bajraszewski, Richmond; David H. Dodds, South Lyon; Greg T. Pezda, Ann Arbor, all of Mich.

[73] Assignee: Ford Motor Company, Dearborn, Mich.

[21] Appl. No.: 315,028

[22] Filed: Sep. 29, 1994

[51] Int. Cl.[6] ..... B21H 5/00

[52] U.S. Cl. ..... 72/10.6; 72/14.3; 72/14.5; 72/30.2; 72/108

[58] Field of Search ..... 72/19, 20, 26, 72/30, 102, 108, 10.4, 10.6, 14.4, 14.5, 19.8, 19.9, 21.4, 21.5, 30.1, 30.2, 14.3; 29/893.32

[56] References Cited

U.S. PATENT DOCUMENTS

| | | | |
|---|---|---|---|
| 3,362,059 | 1/1968 | DiPonio et al. . | |
| 3,387,470 | 6/1968 | Smith, Jr. . | |
| 3,533,258 | 10/1970 | Leonard, Jr. et al. . | |
| 3,550,414 | 12/1970 | List . | |
| 3,712,094 | 1/1973 | Motz et al. | 72/102 |
| 4,602,492 | 7/1986 | Brif et al. | 72/30 |
| 4,614,098 | 9/1986 | Kotera . | |
| 4,616,494 | 10/1986 | Kotera . | |

FOREIGN PATENT DOCUMENTS

| | | | |
|---|---|---|---|
| 3049208 | 8/1982 | Germany | 72/108 |
| 2098901 | 12/1982 | United Kingdom | 72/108 |

*Primary Examiner*—Lowell A. Larson
*Attorney, Agent, or Firm*—Donald A. Wilkinson; Roger L. May

[57] ABSTRACT

A gear rolling machine includes a pair of gear rolling dies for finish forming teeth on external gear blanks. A force sensor is mounted to the machine to monitor the amount of force applied to the gear blank by the rolling dies as one rolling die is infed toward the other during the rolling process. The sensor is electronically connected to a controller that stops the infeed when a predetermined force level is attained during the rolling process.

10 Claims, 2 Drawing Sheets

FORCE CONTROLLED ROLLING OF GEARS

FIELD OF THE INVENTION

The present invention relates to rolling of external gears and more particularly to force feedback controlled rolling to finish form gear teeth on external gears.

BACKGROUND OF THE INVENTION

A currently used finishing process for cold forming teeth on an external gear is to roll the teeth on a gear rolling machine. This process involves rolling a gear blank, after having been hobbed, between a pair of rotating gear dies that have die teeth on their outer surfaces. The gear blank is engaged between the rolling dies, which move linearly closer together while rolling to gradually finish form the teeth. The linear movement is limited by a fixed stop or linear displacement sensor that ceases the linear motion of the gear dies when a predetermined position is reached. This process results in a fixed, as rolled, tooth thickness.

Because of the variations inherent in hobbing when rough forming the gear teeth, the hobbed part tooth thickness varies, and the amount of material on a gear blank that is moved by the gear dies also varies between parts. This current process produces good results only if incoming roughed parts are held within a tight size tolerance range. If not, excessive force levels can be generated for these out-of-tolerance blanks, which allows unnecessary force to be transferred into the stop of the rolling machine. Further, when rolling a gear, the tooth profile will vary with the amount of material moved. Consequently, the size variation of input parts can cause inaccurately produced forms with current position feedback systems used with the roll finishing process.

It has been determined that, if the same amount of material is moved on each part rolled, each part will have a constant involute profile, which causes less tooth-to-tooth to-tooth profile variability. Further, if a consistent amount of material is moved during the roll finishing operation, excessive force levels on the rolling machine can be avoided.

A different type of rolling machine, generally used for the distinct purpose of rolling flat sheets of stock to a desired thickness, uses continuous die force monitoring on a series of pairs of smooth rollers. It forms the flat, smooth material by slowly thinning it out as it passes through each pair of rollers. However, these machines are designed and used for the purpose of providing a flat smooth sheet by rolling linearly through the series of roller pairs oriented ninety degrees from the flat sheet, and do not necessarily provide the type of apparatus and monitoring necessary to finish form the involute surfaces of a cylindrically shaped external gear, or have the same concerns with the amount of material moved to maintain a proper tooth profile regardless of the tolerances of a hobbing process.

SUMMARY OF THE INVENTION

In its embodiments, the present invention contemplates a gear rolling machine for force controlled rolling of external gear teeth on a gear blank. It comprises a fixed rolling die, having a substantially fixed axis of rotation, and a movable rolling die, spaced from the fixed rolling die, creating an opening for receiving the gear blank, with the movable rolling die having a linearly movable axis of rotation parallel to the fixed axis of rotation and being linearly movable in a direction normal to the axes. The rolling machine also includes a means for causing rotation of the fixed and movable rolling dies, and means for causing relative linear motion between the fixed and movable rolling dies. A force sensing means, for measuring the force applied to the gear blank by the rolling dies, and a controller, coupled to the force sensing means, for ceasing relative axial motion between the rolling dies when a predetermined force level is sensed by the force sensor are also included in the rolling machine.

Further, the present invention contemplates a method of finish rolling external gear teeth of a gear comprising the steps of: providing a pair of gear rolling dies, spaced from one another, with each including a rotation axis, and with the two axes parallel to one another; inserting the gear blank between the two gear rolling dies; rotating the gear rolling dies in the same direction; axially moving one of the gear rolling dies toward the other gear rolling die substantially normal to the axes; sensing the axial force applied to the gear blank by the gear rolling dies; and, ceasing the axial movement between the gear rolling dies when the axial force sensed reaches a predetermined force limit.

Accordingly, an object of the present invention is to provide a gear rolling machine that will incorporate force feedback sensors to monitor the infeed of rolling dies during the gear rolling process and stop it when a predetermined rolling force has been reached, thereby finish forming external gear teeth.

An advantage of the present invention, by stopping the infeed at a desired force level, will be to increase output form consistency, thus allowing the use of a broader size range of hobbed parts than displacement based machines. This will, in turn, reduce the number of scrapped parts due to the size variation resulting from tolerances in the hobbing operation.

A further advantage of the present invention is the reduced possibility of reaching excessive force conditions on the rolling dies, which will result in an increase in the rolling die lives.

DETAILED DESCRIPTION OF THE PREFERRED EMBODIMENTS

Figure 1:
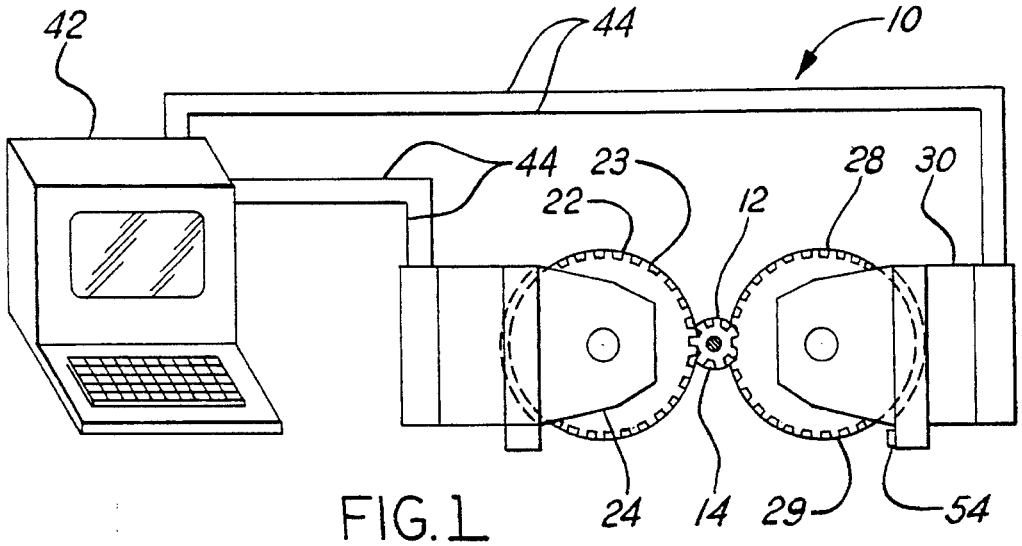
FIG. 1 is a schematic view of a portion of a gear rolling apparatus in accordance with the present invention.
Figure 2:
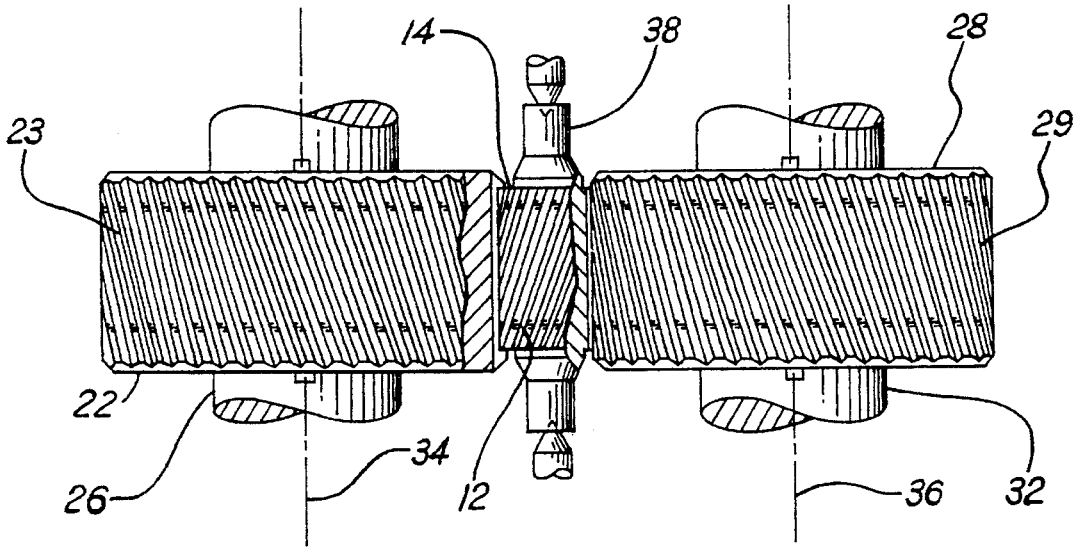
FIG. 2 is a plan view of a pair of rolling dies and a gear blank situated in a position for finish rolling.
Figure 3:
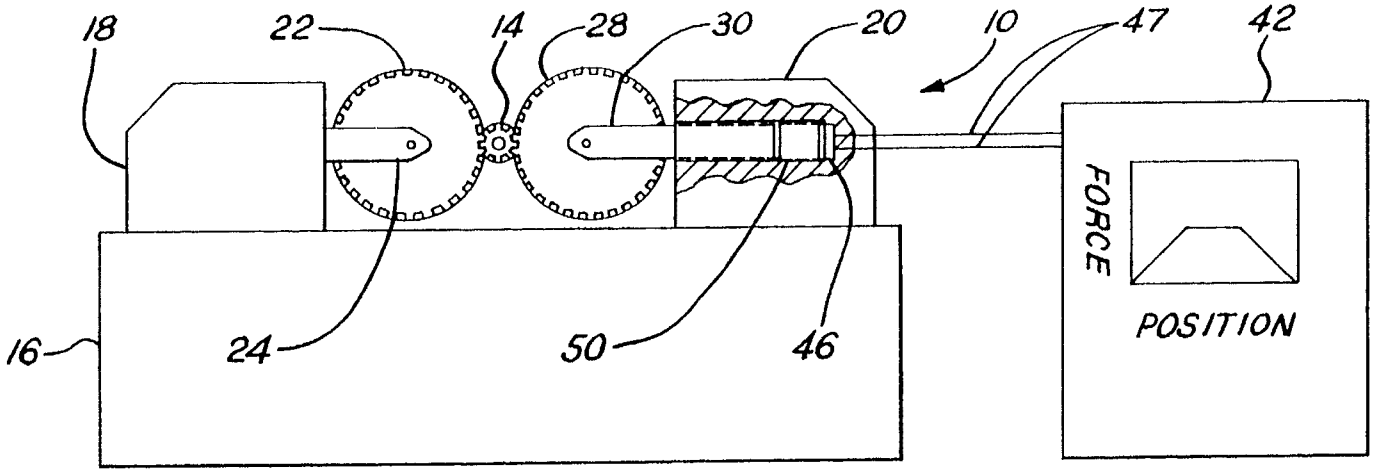
FIG. 3 is a schematic view of a portion of a gear rolling apparatus having a hydraulic cylinder and corresponding force sensor, and showing a preferred force curve.

A force controlled gear rolling machine 10, used to finish form teeth 12 on an external gear blank 14, is shown in FIGS. 1–3. Rolling machine 10 includes a machine bed 16 with a fixed-die head 18 and a movable-die head 20 mounted thereon. A fixed rolling die 22, having die teeth 23, is rotatably mounted to a fixed support arm 24, by a central shaft 26, that is, in turn, mounted to fixed-die head 18. A movable rolling die 28, having die teeth 29, is rotatably mounted to an axially movable support arm 30, by a central shaft 32, that is, in turn, mounted to movable-die head 20.

Central shafts 26 and 32 each have a central axis, 34 and 36 respectively, with the two axes oriented parallel to one another.

Fixed support arm 24 does not move and maintains fixed rolling die 22 axially stationary. Movable rolling die 28 is mounted to movable supports arm 30, which can be axially moved toward and away from fixed rolling die 22, in a direction generally normal to axes 34 and 36. Central shafts 26 and 32 of rolling dies 22 and 28, respectively, are coupled to a conventional mechanism, not shown, for driving them in the same rotational direction during the gear forming process and are electrically connected 44 to a controller, such as a conventional digital computer 42, which controls the machine operating parameters. Gear blank 14 is positioned between rolling dies 22 and 28 with its hobbed teeth 12 in meshing engagement with them, and is held in place by a conventional positioning mechanism 38. An example of a conventional gear rolling machine is illustrated in U.S. Pat. No. 3,362,059 to DiPonio et al., which is incorporated herein by reference.

A sensor, such as a pressure transducer 46, is mounted to rolling machine 10 to monitor the force being applied by rolling dies 22 and 28 during the forming process. It is electrically connected 47 to computer 42. Computer 42 controls the amount and timing of force applied to gear blank 14 by controlling the linear displacement of movable support arm 30.

Rolling machine 10 includes a conventional hydraulic system to move support arm 30, as shown schematically in FIG. 3. Hydraulic pressure is applied to a hydraulic die infeed cylinder 50 by a conventional hydraulic system, not shown, in order to move support arm 30. Pressure transducer 46 is preferably mounted within hydraulic cylinder 50. The force is measured indirectly by monitoring the hydraulic pressure in cylinder 50. Since the area of end wall 52 in cylinder 50 is known, the applied force corresponding to a measured value of pressure can be determined. Pressure transducer 46 can also be mounted in other locations in order to measure the force being applied to gear blank 14 by rolling dies 22 and 28.

A conventional linear variable displacement transducer 54 is also mounted to rolling machine 10 and electrically connected to computer 42 in conventional manner to measure the relative position of rolling dies 22 and 28 as they are infeeding. Transducer 54 is a backup check for pressure transducer 46 to monitor the total infeed distance and has a minimum limit position beyond which it sends a signal to computer 42 to cease the infeed of movable rolling die 28.

The gear rolling process will now be described. Gear rolling machine 10 is generally of the conventional infeed type in which a gear blank 14 is operated on simultaneously by opposed dies 22 and 28 rotating in the same direction. Fixed rolling die 22 is rotated about fixed axis 34 while movable rolling die 28 is rotated about axis 30 in the same direction and at the same speed. Dies 22 and 28 engage gear blank 14 and movable die 28 is infed laterally toward fixed die 22 as the two dies continue rotating. Pressure transducer 46 monitors the process and provides information to computer 42, which, in turn, controls the linear displacement of movable die 28. Infeed occurs until the predetermined pressure level is sensed by force transducer 46, then computer 42 ceases the infeeding and the end forming occurs at this desired force level for a predetermined amount of time.

A preferred force versus position curve is shown superimposed on computer 42 in FIG. 3. After the force level is maintained for the predetermined amount of time, movable rolling die 28 is retracted and the finished part is removed.

Figure 4:
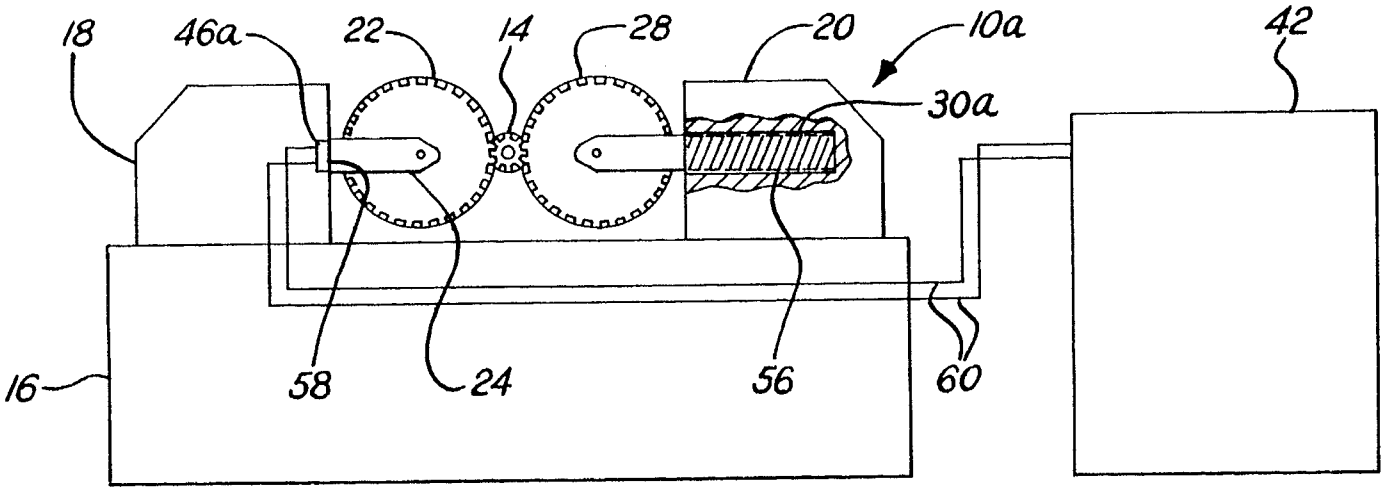
FIG. 4 is a schematic view of an alternate embodiment of a portion of a gear rolling apparatus having a mechanical actuator and corresponding force sensor.

An alternate embodiment, which uses a different way to measure the applied force, is shown in FIG. 4. Rolling machine **10*a* uses a mechanical actuator to infeed support arm 30*a*, such as a ball screw type of infeed mechanism 56. Force sensor 46*a*, is mounted in a spindle housing plate 58, providing continuous monitoring of the force. It is electrically connected 60 to computer 42. Ball screw infeed 56 is driven by a conventional motor, not shown, with an encoder, which monitors the position of support arm 30** at all times. It does so by inferring the location by keeping track of the amount of movement of the motor. For this mechanism, then, a back-up linear variable displacement sensor can be eliminated.

As a second alternate embodiment, one could apply this force sensing system to rolling multiple gear blanks at the same time in order to further increase efficiency of the overall operation.

While certain embodiments of the present invention have been described in detail, those familiar with the art to which this invention relates will recognize various alternative designs and embodiments for practicing the invention as defined by the following claims.

We claim:

1. A gear rolling machine for force controlled rolling of external gear teeth on gear blank comprising:

a fixed rolling die, having a substantially fixed axis of rotation;

a movable rolling die, spaced from the fixed rolling die, creating an opening for receiving the gear blank, with the movable rolling die having a linearly movable axis of rotation parallel to the fixed axis of rotation and being linearly movable in a direction normal to the axes;

means for causing rotation of the fixed and movable rolling dies;

means for causing relative linear motion between the fixed and movable rolling dies relatively toward one another;

force sensing means for measuring the force applied to the gear blank by the rolling dies; and a controller, coupled to the force sensing means, for ceasing the relative axial motion toward one another between the rolling dies when a predetermined axial force level is sensed by the force sensing means.

2. A gear rolling machine according to claim 1 further comprising displacement sensing means for measuring the distance between the rolling dies and sending a signal to the controller to cease the relative linear motion if a predetermined minimum spacing between the fixed and movable rolling dies is reached before the predetermined force level is sensed.

3. A gear rolling machine according to claim 1 wherein the means for causing relative linear motion comprises a hydraulic cylinder and a movable support arm mounted within the cylinder, with the movable support arm coupled to the movable rolling die.

4. A gear rolling machine according to claim 3 wherein the force sensing means is mounted within the hydraulic cylinder.

5. A gear rolling machine according to claim 4 further comprising a displacement at sensing means for measuring the distance between the rolling dies and sending a signal to the controller to cease the relative linear motion if a predetermined minimum spacing between the fixed and movable rolling dies is reached before the predetermined force level is sensed.

6. A gear rolling machine according to claim 1 wherein the means for causing relative linear motion comprises a movable support arm mounted to a ball screw mechanism.

7. A gear rolling machine according to claim 6 wherein the force sensing means is mounted to the fixed rolling die.

8. A method of finish rolling external gear teeth of a gear comprising the steps of:

providing a pair of gear rolling dies, spaced from one another with each including a rotation axis, and with the two axes parallel to one another;

inserting the gear blank between the two gear rolling dies;

rotating the gear rolling dies in the same direction;

linearly moving one of the gear rolling dies toward the other gear rolling die in a direction which is substantially normal to the axes;

sensing the force applied to the gear blank by the gear rolling dies; and ceasing the relative linear movement toward one another between the gear rolling dies when the axial force sensed reaches a predetermined force limit.

9. A method according to claim 8 further comprising the steps of:

providing a linear displacement sensor that operatively engages the gear dies; and stopping the linear movement between the gear rolling dies if the displacement sensor senses a predetermined minimum spacing between the pair of gear rolling dies before the predetermined force level is sensed.

10. A method according to claim 8 further comprising the steps of:

maintaining the predetermined force limit for a predetermined time period; and linearly moving the gear rolling dies away from one another after the predetermined time period at the predetermined force limit has lapsed.

* * * * *